US007637550B2

(12) United States Patent
Menna

(10) Patent No.: US 7,637,550 B2
(45) Date of Patent: Dec. 29, 2009

(54) STRETCHER AND A PATIENT TRANSPORT SYSTEM

(75) Inventor: Ezio Menna, Collecchio (IT)

(73) Assignee: Stem S.R.L., Medesano (Parma) (IT)

( * ) Notice: Subject to any disclaimer, the term of this patent is extended or adjusted under 35 U.S.C. 154(b) by 0 days.

(21) Appl. No.: 12/177,704

(22) Filed: Jul. 22, 2008

(65) Prior Publication Data

US 2009/0276959 A1 Nov. 12, 2009

(30) Foreign Application Priority Data

May 8, 2008 (IT) ..... RE2008A0040

(51) Int. Cl.
*A61G 1/02* (2006.01)

(52) U.S. Cl. ..... 296/20; 296/19

(58) Field of Classification Search ..... 296/19, 296/20; 5/611, 625, 620, 626, 627
See application file for complete search history.

(56) References Cited

U.S. PATENT DOCUMENTS

2006/0075558 A1* 4/2006 Lambarth et al. ..... 5/611

* cited by examiner

*Primary Examiner*—Lori L Lyjak
(74) *Attorney, Agent, or Firm*—Browdy and Neimark, PLLC

(57) ABSTRACT

A stretcher for transporting patients, comprising a rest plane (2) for supporting a patient in a substantially lying position, and means for raising (3, 35) for raising the rest plane (2) with respect to the surface on which the stretcher (1) is resting, comprising at least two distinct support elements (3) which rest on a ground surface, each of which is connected to the rest plane (2) such as to be able to move, independently of the other thereof, between a respective closed position and a respective open position, such that when both the support elements (3) are in a closed position, the rest plane (2) is supported at a lower height, and when both the support elements (3) are in an open position, the rest plane (2) is supported at a greater height, and motor means (35) for moving the support elements (3) from the respective closed positions into the respective open positions, such as to raise the rest plane (2).

14 Claims, 7 Drawing Sheets

1
2
3
4
5
6
7
26
39
41
42
50
51
52
53
54
55
56
60

STRETCHER AND A PATIENT TRANSPORT SYSTEM

BACKGROUND OF THE INVENTION

1. Field of the Invention

The invention in general relates to a stretcher for transport of patients. In more detail, the invention relates to a stretcher destined to be used on-board emergency and/or casualty vehicles, typically ambulances, for example in order to collect an injured person lying on the ground and transport her or him to a hospital or clinic.

2. Prior Art

As is known, the use of these stretchers generally includes resting the stretcher on the ground at a minimum height therefrom, such as to facilitate manual transfer of the injured person onto the stretcher, and then raising the stretcher with the injured person on it up to a similar height to that of the loading plane of the ambulance, and thereafter to load the patient into the ambulance in order to transport her or him to hospital, where the stretcher will once more have to be unloaded from the ambulance, hopefully without causing trauma or jolts to the injured party.

The stretchers at present in use in ambulances are made and equipped to facilitate and/or render less laborious some of the above-mentioned use stages. Notwithstanding the above, it is constantly true that during at least one of the above-cited use stages, the operators physically have to bear the weight of the stretcher with the injured party on it, which means that the operators are subjected to a considerable physical strain.

For example, stretchers known as "self-loading" are known, which comprise a rest plane for receiving the patient in a lying position, to which at least two support legs are associated, which legs are reclinable from an open position, in which they support the rest plane substantially at the same height as the loading plane of the ambulance, to a closed position, in which they support the rest plane at a height which is close to the ground, in order to facilitate the transfer of the patient onto the stretcher.

The support legs are generally reclinable independently of one another, so that during the loading and unloading stages of the stretcher to and from the ambulance the operator can use at least one support leg to support the weight of the stretcher.

The support legs are further generally associated to spring-activated systems which enable them to open automatically, but only after the stretcher has been physically raised from the ground.

This raising operation therefore must be performed manually by at least two operators, who have to bend over in order to grip the stretcher and thus have to raise it by brute force before the support legs can be opened.

As the raising of the stretcher is done after the injured party has been transferred onto the stretcher, this operation often represents a great strain and can lead to serious injury to the health operators performing it.

In order to alleviate this effort, stretchers for ambulances have been designed with are provided with a motorised system for raising the stretcher on which the patient is lying.

This raising system normally comprises an articulated system, for example a pantograph system, which directly rests on the ground and can assume a retracted configuration in which it supports the rest plane at a minimum height from the ground in order to facilitate transfer of the patient onto the stretcher, and an extended position in which it supports the rest plane at a greater height, about equal to the height of the loading plane of the ambulance.

The articulated system is associated to relative motorised means, for example a hydraulic jack, which activates the system between the above-cited retracted and extended configurations, causing the automatic raising of the rest plane.

However, during the stages of loading and unloading the stretcher to and from the ambulance, the above-mentioned articulated system must be kept in a retracted configuration, such that it cannot provide any rest support for the stretcher, the weight of which must therefore be physically supported by the health operatives.

As the stages of loading and unloading are done with the patient on the stretcher, this operation too is very laborious and can thus be cause of serious physical injuries to the operatives doing it.

SUMMARY OF THE INVENTION

An aim of the present invention is to resolve the above-mentioned drawbacks in the prior art, by providing an automatically-raising stretcher which can be loaded and unloading to and from ambulances, without the operatives' having to support the weight thereof physically.

A further aim of the invention is to attain the above-mentioned objective in the ambit of a simple and rational solution having contained overall costs.

These aims are attained by the characteristics of the invention as reported in the independent claim. The dependent claims delineate preferred and/or particularly advantageous aspects of the invention.

In particular, the invention provides a stretcher which comprises a rest plane which supports a patient in a substantially lying-down posture, and means for raising for raising the rest plane with respect to the surface on which the stretcher is resting.

The means for raising comprise at least two distinct support elements, which rest on the ground, each of which is connected to the rest plane such as to be able to move, independently from the other, between a closed position and an open position, such that when both support elements are in the closed position, the rest plane is supported at a lower height, and when both the support elements are in the open position, the rest plane is supported at a higher level, and motorised means for moving the support elements from the respective closed positions to the respective open positions, such as to raise the rest plane.

Thanks to this solution, the motorised means acting on the support element enable the rest plane to be raised in a totally automatic way, without any physical force necessary on the part of the operative.

Further, thanks to the presence of two independent support elements, during the loading and unloading stages to and from the emergency vehicle, the stretcher can simply rest on at least one of the support elements, without the operative's having to support the entire weight thereof.

The stretcher of the invention can further be effectively used by a single operative.

In a particularly simple and economical constructive version of the invention, each support element of the stretcher is connected to the rest plane by means of hinge means, such that it can rotate between a closed position in which it is reclined on the rest plane, and an open position in which it projects inferiorly with respect to the rest plane.

In this context, it is preferable that the raising of the rest plane is obtained by the motorised means, rotating the supporting elements in opposite directions between the respective closed and open positions, for example such that the elements reciprocally near one another.

Thanks to this solution, the rest plane can be constantly parallel to itself during the raising stage, preventing lateral displacements or dangerous inclination which might compromise the stability of the injured party on board.

In a preferred aspect of the invention, the motorised means comprise at least an independent actuator for each support element, for example an either electrical or hydraulic linear actuator, in which the independent actuators move the support elements both independently and/or contemporaneously.

In this way, the support elements can be moved automatically, each independently of the other, though remaining part of a very simple constructional solution of limited size.

The stretcher preferably also comprises means for automatically moving each support element in a returning direction, i.e. from the open position thereof to the closed position thereof, independently of the other, for example in order to be able to recline the support elements on the rest plane before loading the stretcher on-board an emergency vehicle.

The means for automatically moving comprise spring recall systems, or they can be the same motorised means that activate the support means during the raising, and which are now activated to move in a contrary direction.

The invention also makes available a patient transport system.

The system comprises a stretcher of the above-described type, and a transport vehicle, typically an emergency vehicle such as an ambulance, which is provided with a loading plane which receives the stretcher when the support elements thereof are both in a respective closed position, such that the overall height of the stretcher is lower with respect to when the support elements are both in the respective open position.

In a preferred aspect of the invention, the transport system comprises means for connecting which connect the rest plane of the stretcher to the loading plane of the transport vehicle, when the support elements of the stretcher are both in the open position, such as at least partially to support the weight of the stretcher and enable a first support element, proximal to the vehicle, to move freely from the open position thereof to the closed position thereof in which it is received on the loading plane.

In this way, the stages of loading and unloading the stretcher from the transport vehicle never require the operative's physically supporting the weight of the stretcher, as it will always be supported by the second support element which is still in the open position, as well as by the loading plane of the vehicle itself.

The first support element is preferably destined to pass from the open position thereof to the closed position thereof, rotating from below upwards towards the loading plane of the transport vehicle.

In this way the second support element repeats, in reverse order, the same movement it performs during the raising of the rest plane, such that the articulated means which connect it with the rest plane can be of simple construction.

In a preferred aspect of the invention, the second support element of the stretcher passes from the open position thereof to the closed position thereof in which it is received on the loading plane, rotating in an opposite direction with respect to the first support element close to the vehicle.

In this way, the second support element too performs, in reverse order, the same movement it performs when the rest plane is raised from the ground, contributing to a simplification of the articulated means which join it to the rest plane itself.

Further, as the support elements rotate in opposite directions, they never interfere with each other during the movement, and thus do not require particular constructional peculiarities in order for them to be able to reach their relative closed positions without tangling with one another.

In a further preferred aspect of the transport system of the invention, the means for connecting the stretcher to the loading plane of the transport vehicle are associated to motorised drawing means, which automatically draw the stretcher internally of the transport vehicle, above the loading plane.

BRIEF DESCRIPTION OF THE DRAWINGS

Further characteristics and advantages of the invention will emerge from a reading of the following description, provided by way of non-limiting example, with the aid of the figures of the drawings illustrated in the appended tables, in which.

Figures 5, 5A, 5B:
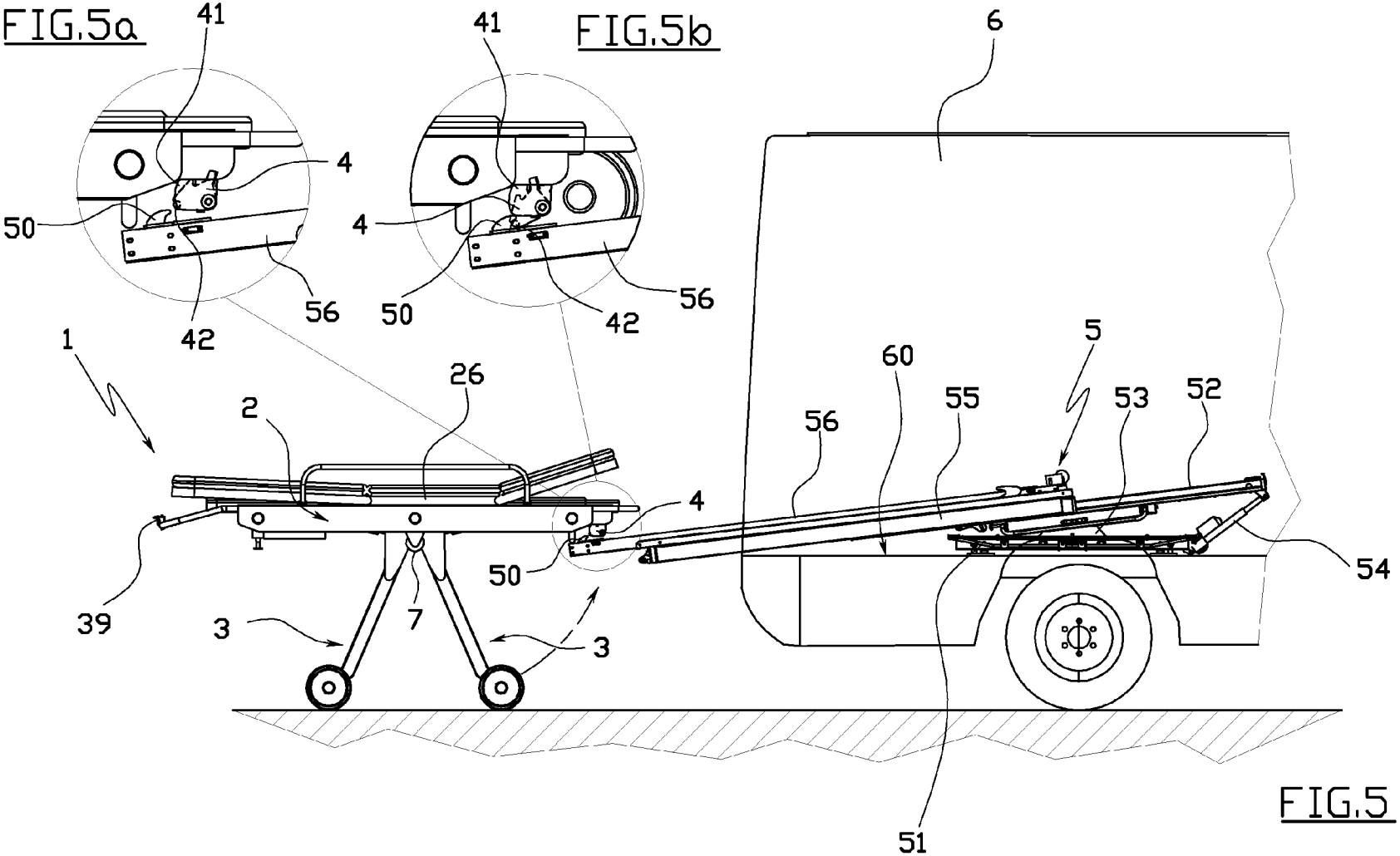
FIG. 5 is a system for transport of patients according to the invention.
FIGS. 5*a* and 5*b* are two details, in enlarged scale, of FIG. 5.

FIGS. from 6 to 9 show the transport system of FIG. 5 during four stages of loading the stretcher on-board the vehicle.

DETAILED DESCRIPTION OF THE INVENTION

The stretcher 1 comprises a rest plane, indicated in its entirety by 2, which receives and supports a patient in a substantially stretched-out lying position.

Figures 3, 3A, 3B:
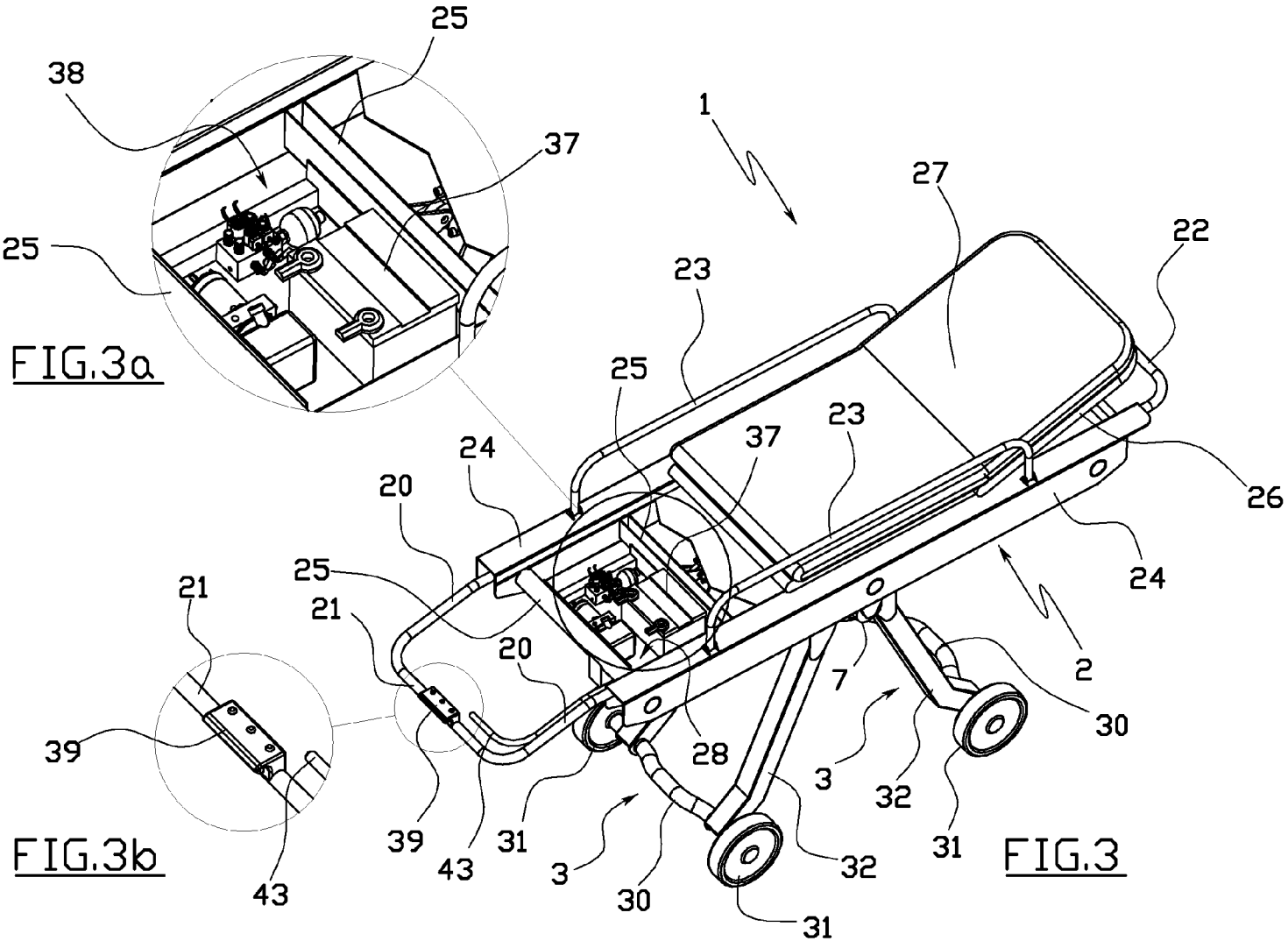
FIG. 3 is a perspective view from above of the stretcher of FIG. 1.
FIGS. 3*a* and 3*b* are two details, in enlarged scale, of FIG. 3.

As illustrated in FIG. 3, the rest plane 2 comprises a frame which is substantially rectangular in plan view, and which comprises two parallel longitudinal struts 20 which are joined at the ends by two transversal struts, respectively a rear strut 21 and a front strut 22.

The transversal rear strut 21 provides a grip which an operative can grip with both hands in order to push and guide the stretcher 1 during movement thereof. A salient edge 23 is provided on each longitudinal strut 20 to prevent the patient from failing laterally off the rest plane 2.

The rest plane 2 further comprises two identical steel longitudinal elements 24, each of which exhibits a tubular shape with a substantially rectangular section, and is threaded on a respective longitudinal strut 20.

The elements 24 are fixed to the relative longitudinal struts 20 and are reciprocally connected by a series of stiffening crossbars 25, which are parallel to one another and are reciprocally distanced along the longitudinal development of the elements 24.

The stiffening crossbars 25 are normally covered over by a bed 26, which is arranged longitudinally and is fixed on the rest plane 2.

In particular, the bed 26 comprises three reciprocally-connected flat portions, which can be adjusted according to transversal articulations, such as to be able to change the inclination thereof, with the aim of offering greater comfort to the patient to be transported.

The bed 26 is further covered by a soft flexible mattress 27, which renders the rest plane more comfortable for the patient.

Two support legs 3 are associated to the rest plane 2, which contact with the surface on which the stretcher is rested.

The support legs 3 are singly connected to the rest plane 2 in order to be able to move independently of one another, between a respective closed position and a respective open position.

Figure 1:
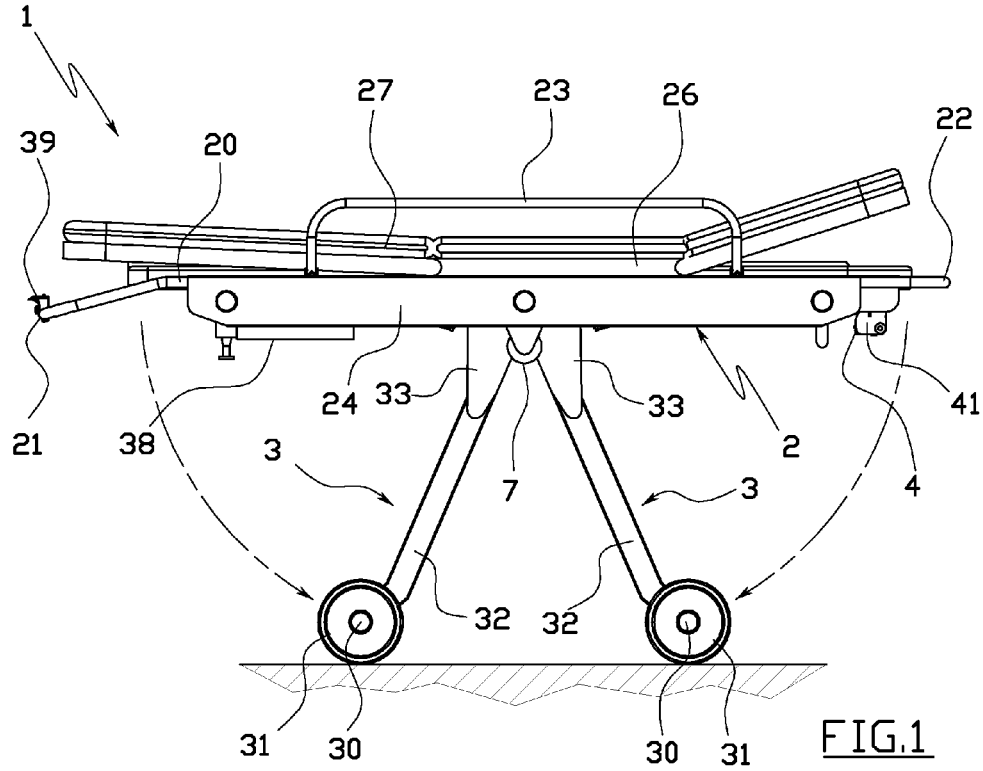
FIG. 1 is a lateral view of a stretcher of the invention, shown with both the support elements in open positions.
Figure 2:
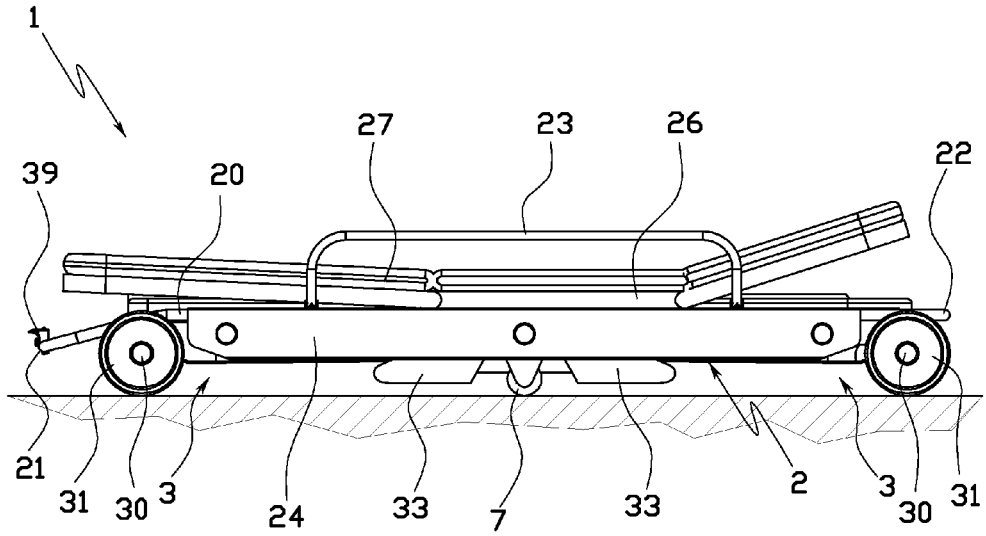
FIG. 2 is the stretcher of FIG. 1, shown with both the support elements in the closed position.

When both the support legs 3 are in the respective open position of FIG. 1, they support the rest plane 2 at a maximum height from the ground; when both the support legs 3 are in the respective closed position of FIG. 2, they support the rest plane 2 at a minimum height.

Figures 4, 4A, 4B:
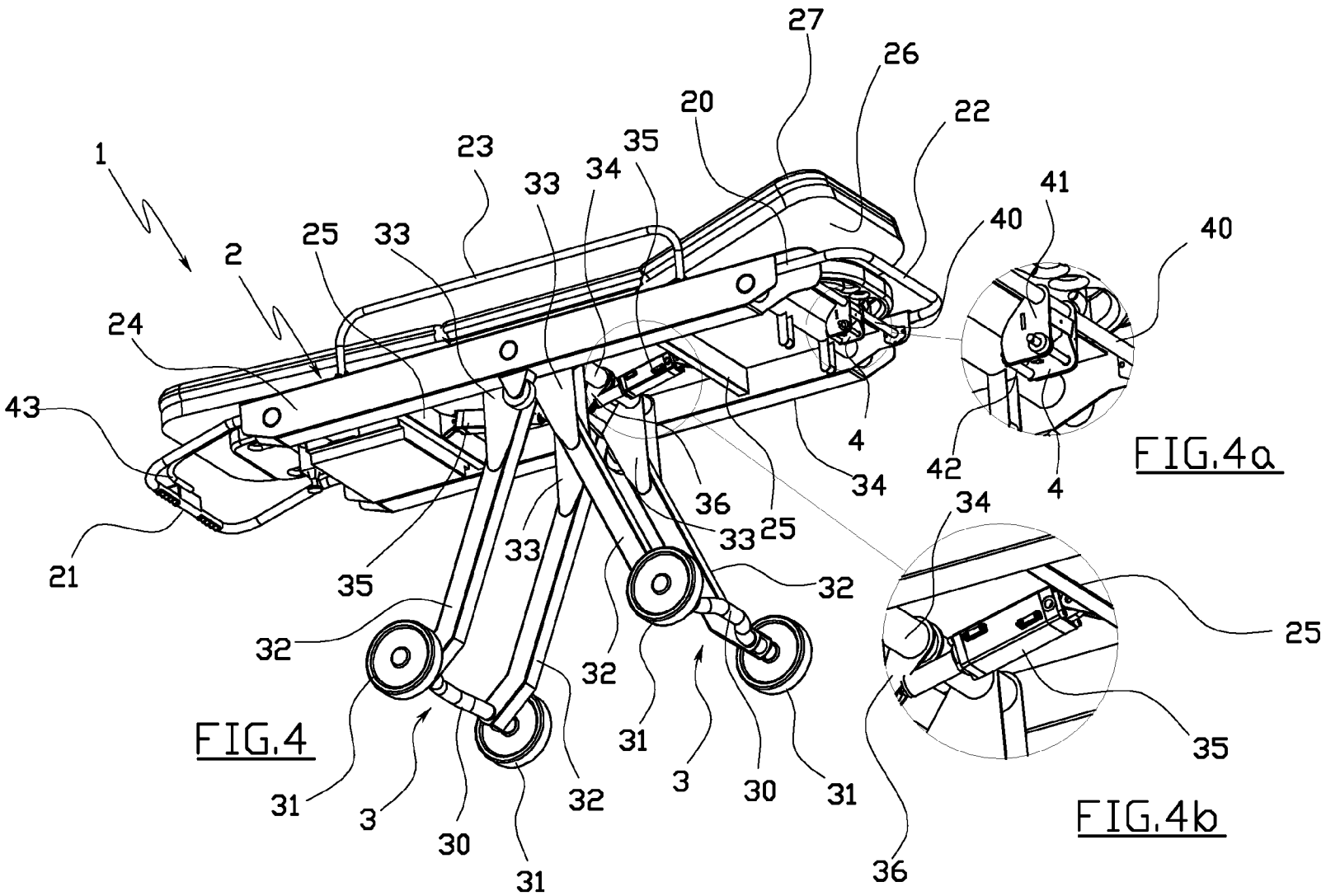
FIG. 4 is a perspective view from below of the stretcher of FIG. 1.
FIGS. 4*a* and 4*b* are two details, in enlarged scale, of FIG. 4.

As illustrated in FIG. 4, each support leg 3 comprises a substantially horizontally-developing fixed axle 30, to opposite ends of which two support wheels 31 having coinciding rotation axes are rotatably coupled.

The fixed axle 30 is borne at the end of two identical shaped bars 32, parallel to and distanced from one another, opposite ends of which are rigidly fixed by means of relative connecting brackets 33 to a single transversal shaft 34 which is oriented parallel to the rotation axis of the support wheels 31.

The transversal shaft 34 is perpendicularly interpositioned between the longitudinal elements 24 of the rest plane 2 to which it is connected by hinge means which enable it to rotate about a central axis thereof.

In this way, the whole support leg 3 can rotate in both directions between the above-mentioned open and closed positions, respectively nearing and distancing the support wheels 31 to and from the rest plane 2.

In particular, the transversal shaft 34 of each support leg 3 is hinged to the rest plane 2 at an intermediate tract of the elements 24, such that the support legs 3 rotate in opposite directions during the displacement between the respective open and closed positions, or vice versa.

A relative linear actuator 35 is associated to each support leg 3.

The linear actuator 35 comprises an external guide body in which a projecting stem axially slides, such as to increase or reduce the total length of the linear actuator 35.

In the illustrated example, each linear actuator 35 is a hydraulic jack, but might be replaced by an electromechanical jack.

As illustrated in FIG. 4*b*, each linear actuator 35 exhibits a first end which is hinged to a stiffening crossbar 25 of the rest plane 2, while the second end is hinged to a lever 36, which is keyed fixedly to the centre of the transversal shaft 34 of the relative support leg 3.

The hinge axes of the linear actuator 35 are both parallel to the axis of the transversal shaft 34, and the linear actuator 35 is positioned in the dihedron formed by the relative support leg 3 with the rest plane 2, such that a rotation of the support leg 3 towards the open position corresponds to a lengthening of the linear actuator 35, while a rotation of the support leg 3 towards the closed position corresponds to a shortening of the linear actuator 35.

In the illustrated example, the linear actuators 35 are double-acting, i.e. they can both lengthen and shorten actively with the aim of motorising both the opening and the closing of the respective support legs 3.

According to the invention, it is however sufficient for the linear actuators 35 only to lengthen actively, with the aim of motorising at least the opening of the relative support legs 3. The closure of the support legs 3 might be obtained by respective spring recall means, acting directly on the support legs 3 or indirectly on the relative linear actuator 35.

The linear actuators 35 are supplied by a single energy source, in the example a battery 37, which is installed on the stretcher 1.

As illustrated in FIGS. 3 and 3*a*, the battery 37 is housed in a chamber 28 which is afforded between two consecutive stiffening crossbars 25 below the bed 26.

The linear actuators 35 are controlled by manual control means 39, which are mounted on the transversal rear strut 21 of the rest plane 2, at the grip position, such as to be easily activated by the operative pushing the stretcher 1.

In the illustrated example, the control means 39 comprise a set of buttons, but could comprise any suitable means, for example a series of levers.

The stretcher 1 further comprises a pair of auxiliary wheels 7, having coincident rotation axes which are oriented parallel to the rotation axes of the support wheels 31, each of which is fixed below a respective element 24 of the rest plane 2.

As illustrated in FIG. 2, the auxiliary wheels 7 are positioned substantially at the same height as the support wheels 31 when the support legs 3 are in the closed position, and are arranged in a central tract of the elements 24, interposed between the transversal shafts 34 of the support legs 3.

The stretcher 1 comprises a pawl 4, which is borne by a transversal rod 40 fixed perpendicularly between the longitudinal elements 24, at the front end of the rest plane 2.

As illustrated in FIG. 4*a*, the pawl 4 is joined to the transversal rod 40 via a fixed support bracket 41 to which it is hinged such that a rotation axis thereof is parallel to the transversal rod 40.

The pawl 4 comprises an eccentric pin 42, parallel to the transversal rod 40.

Thanks to the rotation of the pawl 4, the eccentric pin 42 can selectively move into a disengaged raised position, or an engaged lowered position, which are respectively shown in FIGS. 5*a* and 5*b*.

The rotation of the pawl 4 in both directions is obtained by means of a spring system (not illustrated), which is controlled by a manual lever 43 positioned at the rear transversal strut 21 of the rest plane 2, such as to be easily activated by the operative pushing the stretcher.

As illustrated in FIG. 5, the pawl 4 cooperates with a hook 50 mounted on-board an emergency vehicle 6, in the example on-board an ambulance, which comprises a loading plane 60 which receives the stretcher 1 in order to transport it to places which might be very distant.

In particular, the hook 50 belongs to a loading device, denoted in its entirety by 5, which schematically comprises a support base 51 fixed on the loading plane 60 of the emergency vehicle 6, and an inclinable plane 52 connected to the support base 51 by means of joint means 53 which enable the inclinable plane 52 to be inclined in a downwards direction towards the rear edge of the loading plane 60.

The inclination of the inclinable plane 52 is control by an electric jack 54.

The loading device 5 further comprises a slidable platform 55, which slides on the inclinable plane 52 towards the rear part of the loading plane 60 and vice versa.

Figure 9:
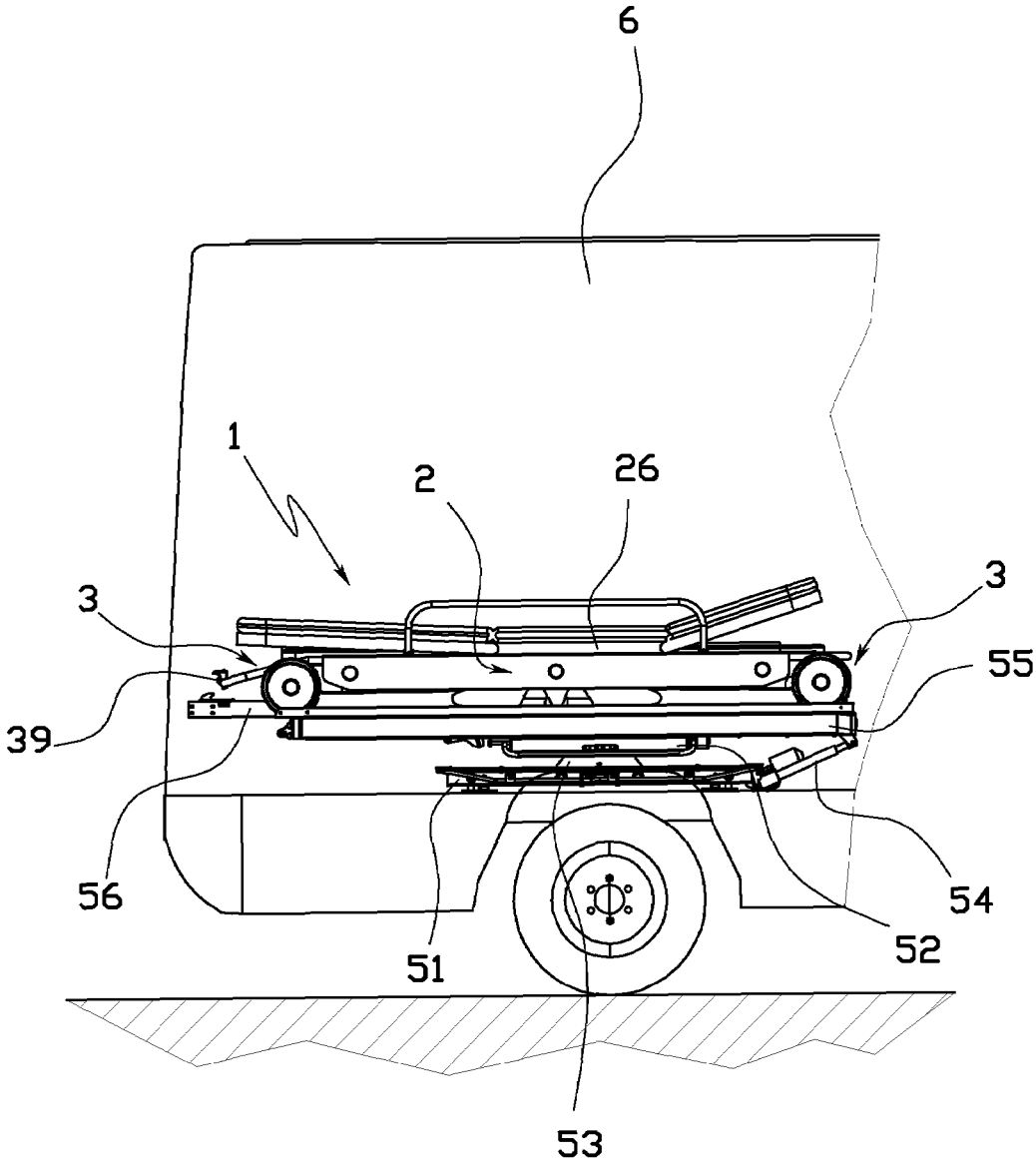

In particular, the slidable platform 55 slides between an extracted position, shown in FIG. 5, in which it projects posteriorly from the loading plane 60, and a retracted position, shown in FIG. 9, in which it is completely contained above the loading plane 60.

A fixed guide 56 is set on the slidable platform 55, oriented in the same direction as the platform 55.

The fixed guide 56 projects partially from the rear edge of the slidable platform 55.

The above-mentioned hook 50 is slidable coupled to the fixed guide 56, which moves thereon from the projecting end towards the opposite end, activated by motorised drawing means, which are not illustrated as they are of known type.

In use, the stretcher 1 is rested on the ground with the support legs 3 both in the respective closed position, as illustrated in FIG. 2.

In this way, the rest plane 2 is at a minimum height from the ground, and enables the health operatives to load an injured person onto the bed 26 easily.

After having loaded the injured person, a single operative activates the linear actuators 35 using the buttons 39 which are on the grip of the stretcher 1.

The linear actuators 35 act contemporaneously, such as to rotate the respective support legs 3 in opposite directions, from the closed position to the open position (as indicated in FIG. 1).

In this way, the support legs 3 reciprocally near, thus distancing the relative support wheels 31 from the rest plane 2, such that the rest plane 2 progressively rises from the ground.

In particular, note that the support legs 3 are identical to one another and that the linear actuators 35 cause them to rotate contemporaneously in opposite directions by equal angles, such that the rest plane 2 is raised, translating from below in an upwards direction, keeping the inclination thereof unchanged with respect to the ground.

This detail means that the rest plane 2 can be raised with the injured party on board, without the risk that the patient might be subjected to dangerous jolting or might even slip from the bed 26 on which she or he is lying.

When both the support legs 3 reach the open position illustrated in FIG. 1, the rest plane 2 is at a higher level from the ground, which enables a standing operative to comfortably grip the transversal rear strut 21 of the stretcher 1.

The stretcher 1 rests on the ground by the support wheels 31, such that the operative can push it and guide it to move on the ground, for example to position it at the emergency vehicle 6 before loading it on the loading plane 60.

As illustrated in FIG. 5, the stage of loading the stretcher 1 means that initially the inclinable plane 52 of the loading device 5 is oriented from top to bottom towards the rear part of the emergency vehicle 6.

The sliding platform 55 is brought into the extracted position thereof, such that it projects posteriorly with respect to the loading plane 60, and the hook 50 is stopped at the projecting end of the fixed guide 56.

The hook 50 is thus positioned externally of the emergency vehicle 6, at a height from the ground that is less than that of the rest plane 2 of the stretcher 1, the support legs 3 of which are both in the open position.

The stretcher 1 is oriented such as to have the front part thereof facing towards the rear part of the emergency vehicle 6, taking care to align the pawl 4 with the fixed guide 56 on which the hook 50 runs.

As illustrated in FIGS. 5*a* and 5*b*, the pawl 4 is initially in the disengaged position, and the stretcher 1 is advanced by the operator up to when the pawl 4 passes above and beyond the hook 50.

At this point, by activating the manual lever 43, the operator commands the rotation of the pawl 4, which lowers and clicks into the hooked position, in which the eccentric pin 42 couples in the cavity of the hook 50.

In this position, the stretcher 1 is not only hooked-up but also rests on the loading device 5 such that the weight thereof is at least partially supported by the loading plane 60 of the emergency vehicle 6.

The operator thus commands the displacement of the front support leg 3 from the open position to the closed position, at the same time keeping the rear support leg 3 in the open position.

In the illustrated example, the displacement is motorised thanks to the shortening of the relative double-acting linear actuator 35. Note however that the displacement could also be obtained by means of a further automatic system, for example a spring system, should the linear actuator 35 be single-acting.

Figure 6:
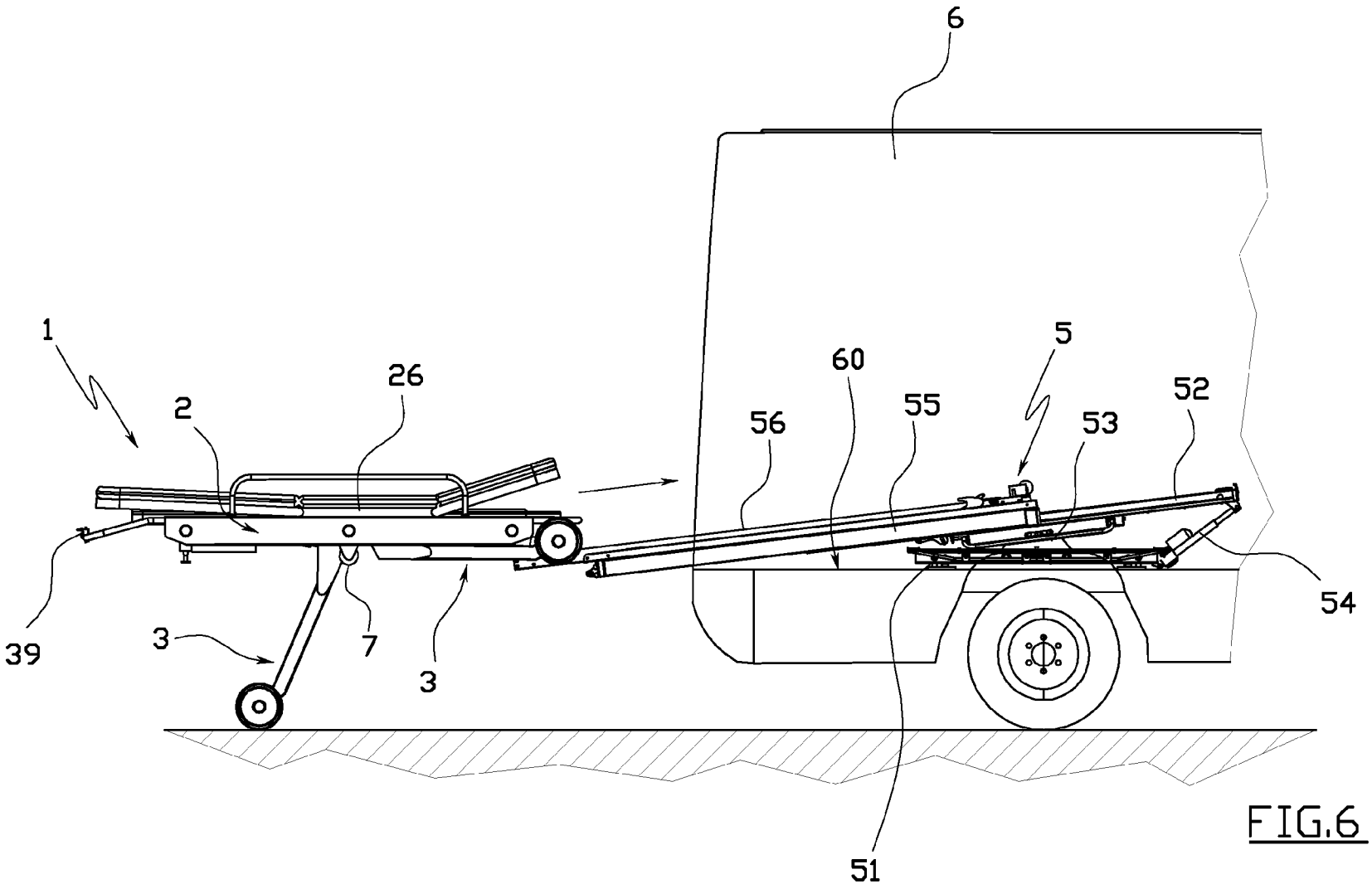

As illustrated in FIG. 6, at the end of the displacement of the front support leg 3, the rest plane 2 is stably supported by the rear support leg and the loading plane 60 of the emergency vehicle 6, to which it is connected via the loading device 5.

Note that the displacement of the front support leg 3 from the open position to the closed position is done by means of an upwards rotation towards the emergency vehicle 6, i.e. the support leg 3 performs, inversely, the same movement it performed during the raising of the rest plane 2.

The forwards rotation is enabled by the fact that the fixed guide 56 to which the hook 50 is coupled projects with respect to the sliding platform 55, such that the platform 55 does not interfere with the raising of the support wheels 31.

It is stressed that the choice of causing the front support leg 3 to follow the same trajectory both during the raising and during the stage of loading the stretcher 1 advantageously enables simplification from the constructional point of view not only of the support legs 3, which never interfere with one another, but also the kinematic mechanisms which enable the linear actuators 35 to move them.

Figure 7:
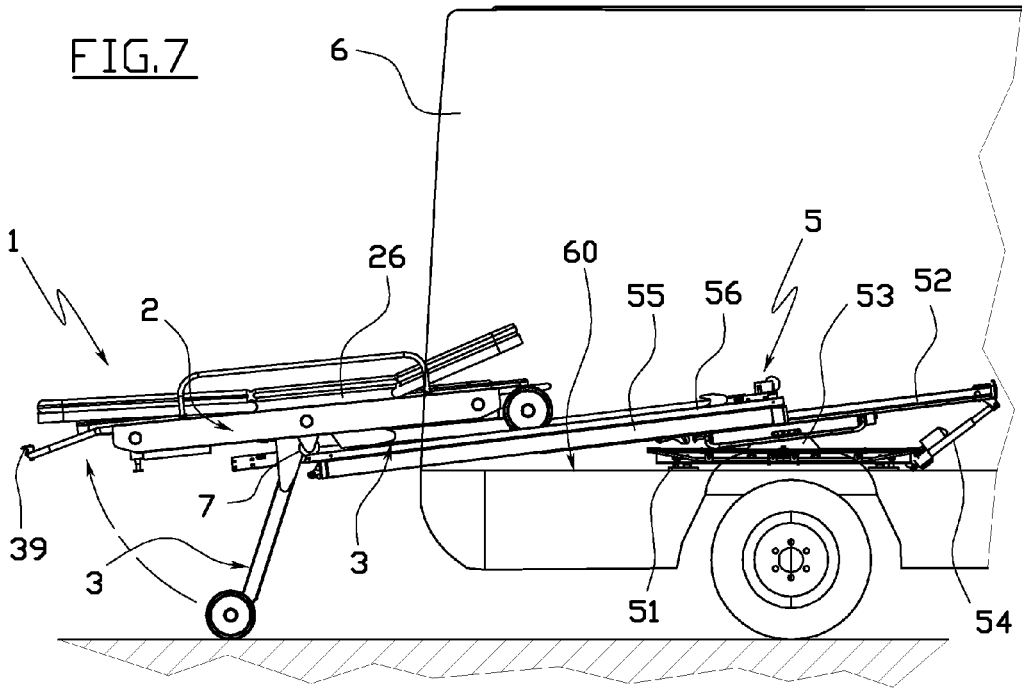

Starting from the configuration of FIG. 6, the hook 50 is activated to run on the fixed guide 56 towards the inside of the emergency vehicle 6, drawing with it the pawl 4 and thus forcing the rest plane 2 of the stretcher 1 to run progressively on the slidable platform 55 up to when the auxiliary wheels 7 rest thereon (see FIG. 7).

Figure 8:
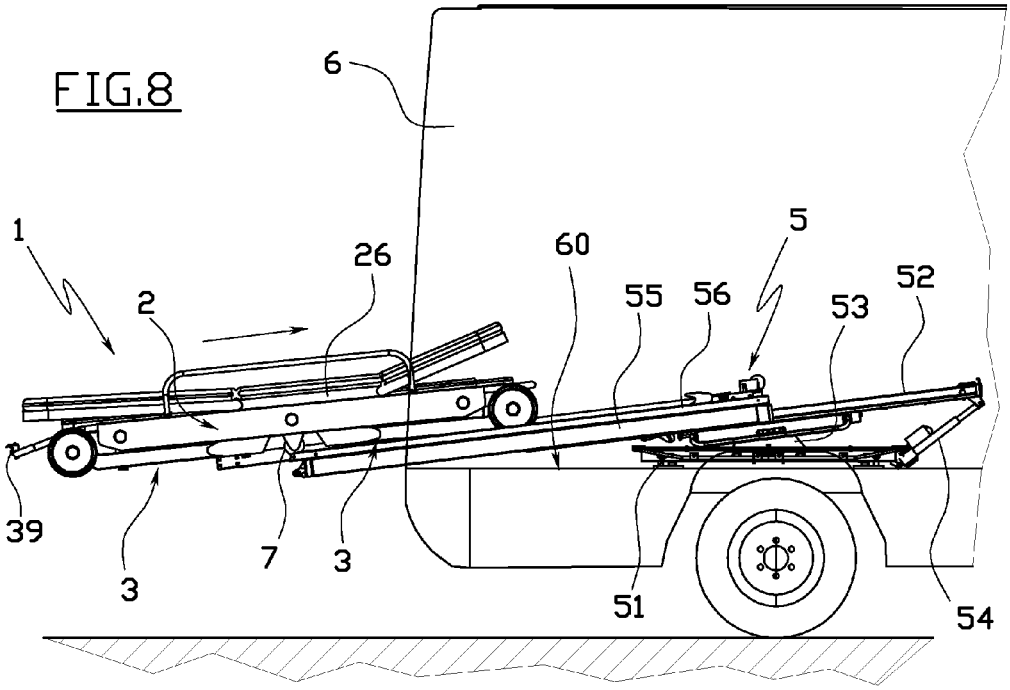

At this point, the operative commands the rotation of the rear support leg 3 from the open position thereof to the closed position thereof, thus reaching the configuration shown in FIG. 8.

Note that this rotation of the rear support leg 3 happens in an opposite direction with respect to the direction of the front support leg 3 beforehand.

In the illustrated example, the rotation of the rear support leg 3 is motorised thanks to the shortening of the relative double-acting linear actuator 35. Note that, however, in this case too the rotation could be obtained by means of a different automatic system, for example a spring system should the linear actuator 35 be of a single-acting type.

As illustrated in FIG. 8, when the rear support leg 3 reaches the closed position thereof, the rest plane 2 of the stretcher 1 is stably resting on the slidable platform 55 of the loading device 5, where it is retained by the hook 50.

At this point, the hook 50 is commanded to slide further towards the inside of the emergency vehicle 6 up to when all the support wheels 31 of the stretcher 1 rise up to rest on the slidable platform 55.

The slidable platform 55 with the stretcher 1 on board is thus displaced into the retracted position on the inclinable plane 52, which is rotated with respect to the support base 51 such as to bring it into a horizontal position on the loading plane 60 of the emergency vehicle 6 (see FIG. 9).

The unloading stage of the stretcher 1 from the emergency vehicle 6 will be done by repeating, in reverse order, the operations for loading as described above, therefore causing the rear support leg 3 to descend first and thereafter the front support leg 3.

Obviously a technical expert in the field might make numerous changes of a technical-applicational nature to the stretcher 1 and the means for interacting between the stretcher and the emergency vehicle 6 as above-described, without forsaking the ambit of protection of the invention as claimed herein below.

The invention claimed is:

1. A stretcher for transporting patients, comprising; a rest plane (2) for supporting a patient in a substantially lying position and means for raising (3, 35) the rest plane (2) with respect to a surface on which the stretcher (1) is resting, wherein the means for raising comprise:

at least two distinct support elements (3) which rest on a ground surface, each of which is connected to the rest plane (2) and is not connected to each other where in each of the supported elements is able to move, independently of each other between a respective closed position and a respective open position, such that when both the support elements (3) are in a closed position, the rest plane (2) is supported at a lower height, and when both the support elements (3) are in an open position, the rest plane (2) is supported at a greater height, wherein each support element (3) is able to reach the closed position while the other element is in the open position:

a motor means (35) for moving the support elements (3) from the respective closed positions into the respective open positions, such as to raise the rest plane (2).

2. The stretcher of claim 1, wherein each of the support elements (3) is hinged to the rest plane (2), such as to be able to rotate between a closed position in which the each of the support elements (3) is reclining on the rest plane (2), and an open position, in which the each of the support elements (3) projects inferiorly with respect to the rest plane (2).

3. The stretcher of claim 2, wherein the motorised means (35) are 20 predisposed to raise the rest plane (2), rotating the support elements (3) in opposite directions during the displacement between the respective open and closed positions.

4. The stretcher of claim 3, wherein the support elements (3) are hinged at intermediate points of the rest plane (2), and the motorised means (35) are predisposed to raise the rest plane (2), by rotating the support elements (3) in a reciprocally nearing direction.

5. The stretcher of claim 1, wherein each of the support elements (3) comprises support wheels (31) which enable displacements of the stretcher (1) on the surface on which the stretcher (1) is resting.

6. The stretcher of claim 1, wherein the motorised means comprise at least an independent actuator (35) for each support element (3), the independent actuators (35) moving the support elements (3) both independently of one another and contemporaneously.

7. The stretcher of claim 6, wherein the independent actuator (35) is a linear actuator.

8. The stretcher of claim 1, wherein the stretcher comprises means for moving each support element (3) from the open position thereof to the closed position thereof, independently of the other each support element (3).

9. The stretcher of claim 8, wherein the means are the motorized means (35) for raising the rest plane (2).

10. A system for transporting patients of claim 1, wherein said system comprises a stretcher (1) and a transport vehicle (6) provided with at least a loading plane (60) for receiving the stretcher (1), when the support elements (3) of the stretcher (1) are both in a respective closed position, such that an overall height of the stretcher (1) is lower than when the support elements (3) are both in the respective open position.

11. The system of claim 10, wherein said system comprises connecting means (4, 5) which connect the rest plane (2) of the stretcher (1) to the loading plane (60) of the transport vehicle (6) when the support elements (3) of the stretcher (1) are both in the open position, such as at least partially to support the stretcher (1) and enable a first support element (3) in proximity of the vehicle to move from the open position thereof into the closed position thereof in which it is received onto the loading plane (60).

12. The system of claim 11, wherein the first support element (3) displaces from the open position to the closed position, rotating in an upwards 30 direction towards the loading plane (60) of the transport vehicle (6).

13. The system of claim 12, wherein the second support element (3) of the stretcher (1) passes from the open position thereof to the closed position thereof in which it is received on the loading plane (60), rotating in an opposite direction with respect to the first support element (3).

14. The system of claim 11, wherein the connecting means (4, 5) are associated to motorised drawing means which automatically draw the stretcher (1) internally of the transport vehicle (6) above the loading plane (60).

* * * * *